US005823354A

United States Patent [19]

Elkind et al.

[11] Patent Number: 5,823,354

[45] **Date of Patent: *Oct. 20, 1998**

[54] METHOD AND APPARATUS FOR THE SEPARATION AND SORTING OF NON-FERROUS MATERIALS

[75] Inventors: Alexander Elkind, Mt. Laurel; James MacFarlane, Collingswood, both of N.J.; Mark Krymsky, Langhorn, Pa.; Victor Nikolaevich Tisenko, St. Petersburg, Russian Federation; German Abramovich Shneerson, St. Petersburg, Russian Federation; Vyacheslav Semenovich Korolev, St. Petersburg, Russian Federation; Sergey Ivanovich Krivosheev, St. Petersburg, Russian Federation; Alexey Pavlovich Nenashev, St. Petersburg, Russian Federation; Vladimir Markovich Vasilevskiy, St. Petersburg, Russian Federation

[73] Assignee: Rustec, Inc., Camden, N.J.

[ * ] Notice: This patent issued on a continued prosecution application filed under 37 CFR 1.53(d), and is subject to the twenty year patent term provisions of 35 U.S.C. 154(a)(2).

[21] Appl. No.: 585,097

[22] Filed: Jan. 16, 1996

[51] Int. Cl.[6] ..... B03C 1/00

[52] U.S. Cl. ..... 209/212; 209/223.1; 209/227; 209/636

[58] Field of Search ..... 209/212, 223.1, 209/223.2, 225, 226, 227, 636

[56] References Cited

U.S. PATENT DOCUMENTS

| | | | |
|---|---|---|---|
| 1,829,565 | 10/1931 | Lee | 209/212 |
| 4,029,573 | 6/1977 | Theodore et al. | 209/212 |
| 4,069,145 | 1/1978 | Sommer, Jr. et al. | 209/212 |
| 4,157,297 | 6/1979 | Alth | 209/212 |
| 4,238,323 | 12/1980 | Zakharova et al. | 209/212 |
| 4,743,364 | 5/1988 | Kyrazis | 209/212 |
| 4,834,870 | 5/1989 | Osterberg et al. | 209/38 |
| 4,869,811 | 9/1989 | Wolanski et al. | 209/212 |
| 5,060,871 | 10/1991 | Brassinga et al. | 241/24 |
| 5,064,075 | 11/1991 | Reid | 209/636 |
| 5,080,234 | 1/1992 | Benson | 209/212 |
| 5,423,433 | 6/1995 | Arnold et al. | 209/636 |
| 5,494,172 | 2/1996 | Siesco, Jr. | 209/212 |

FOREIGN PATENT DOCUMENTS

| | | | |
|---|---|---|---|
| 5064753 | 3/1993 | Japan | 209/212 |
| 1233937 | 5/1986 | U.S.S.R. | 209/212 |
| 1680332 | 9/1991 | U.S.S.R. | 209/212 |

OTHER PUBLICATIONS

Knoepfel, H. "Pulsed High Magnetic Fields: Physical effects and generation methods concerning pulsed fields up to the megaoersted level", Laboratorio Gas Ionizzati (Euroatom–CNEN) Frascati, North–Holland Publishing Co., Amsterdam, London, 1970, p. 70, p. 73.

Shneerson G.A. "Fields and unsteady–state process in the apparatuses of super–high currents", 2nd Ed. Energoatomisdat, 1992. p. 416.

*Primary Examiner*—Tuan N. Nguyen

*Attorney, Agent, or Firm*—Law Offices of Jane Massey Licata

[57] ABSTRACT

An apparatus for separating and sorting non-ferrous metals from other materials is provided which has a ferromagnetic core, an infeed conveyor for positioning materials to be separated and sorted, and a collecting bin or container located at a selected distance from the infeed conveyor for collecting separated and sorted non-ferrous metals, and which produces an electromagnetic field which provides a non-steady state, non-uniform magnetic field, and a sharp skin effect in the non-ferrous metal piece. Also provided is a method for separating and sorting non-ferrous metal pieces from other materials wherein non-ferrous metal pieces are subjected to a non-steady state, non-uniform magnetic field so that a sharp skin effect is produced in the non-ferrous metal piece so that the non-ferrous metal piece is separated and sorted according to its density and independent of its conductivity.

7 Claims, 11 Drawing Sheets

METHOD AND APPARATUS FOR THE SEPARATION AND SORTING OF NON-FERROUS MATERIALS

BACKGROUND OF THE INVENTION

There are various known methods for the separation of non-ferrous metals from other materials. Alternating electromagnetic fields have been used to generate eddy currents in metals. For example, rotating or steady state magnets have been used to generate low frequency electromagnetic fields. Interaction between the generated eddy currents and the alternating magnetic field results in the displacement of metal pieces. The metals can then be separated based on their altered trajectories. However, due to the low frequency of the electromagnetic field, the trajectories of individual metal pieces differ only slightly from each other and, thus, may not be sufficient for separation of distinctive metal groups, e.g., primary and alloy metal groups.

There are also established methods for the separation of non-ferrous metals based upon their conductivity, utilizing a steady-state, high frequency electromagnetic field. However, the interaction between the electromagnetic field and the individual metals pieces has not proven to be powerful enough to provide distinctive variation between the trajectories of the various metals to allow for effective separation.

U.S. Pat. No. 5,423,433 discloses a material separator apparatus including an electromagnet within a continuous conveyor belt which supports and transports the materials to be separated; a means to produce an alternating current to the electromagnet; and a means to control the wave form of the alternating current to maximize the repulsive efficiency of the eddy current. The apparatus includes an electromagnet within the continuous belt. An alternating current drives the electromagnet to produce a magnetic field which induces an eddy current in the materials to be separated.

U.S. Pat. No. 5,080,234 discloses an eddy current separator employing a first and second cylinder, each of which is capable of generating a magnetic field. A mixture of electrically conductive and nonconductive particles is fed into the gap between the cylinders. The cylinders are rotated. Electrically conductive nonmagnetic particles are impelled by eddy currents generated by the magnetic flux projected across the gap between the cylinders and are collected separately from free-falling nonconductive particles.

U.S. Pat. No. 5,064,075 discloses a method for separating predetermined non-magnetic electrically conductive items from a flow of non-magnetic electrically conductive materials containing such items and other non-magnetic electrically conductive materials. The flow of the material is passed adjacent to an electromagnetic field generating apparatus. The flux field generated by the apparatus is controlled such as to create electrical currents within the predetermined electrically conductive items. The currents react with the generated electromagnetic flux field causing the creation of a directional force upon the predetermined items such as to move only the predetermined electrically conductive items out of and away from the flow of the material.

U.S. Pat. No. 5,060,871 describes a method for separating metal alloy particles of different sizes and conductivity and, more particularly, separating an aluminum-lithium alloy from a scrap mixture of aluminum alloys. In the method of the invention, the scrap mixture is crushed into flat particles, physically separated on a sloping, vibrating separator table having a rapidly changing magnetic field which moves across the separator table. The rapidly changing magnetic field moves the larger and more conductive particles along one path, and the smaller and less conductive particles along another.

U.S. Pat. No. 4,869,811 discloses an apparatus for the separation of non-ferrous metals. In this invention, the design of the magnetic rotor causes eddy currents in the scrap pieces passing over the rotor which set up repulsive forces, causing the pieces to separate. The apparatus comprises a rotatable non-ferrous metal magnetic separator having a hollow cylindrical drum rotating around a central axis, with closely spaced, narrow, permanent magnets positioned around the drum periphery in rows. The rows of magnets are alternately radially thick and thin around the drum. The magnetic polarity of the thicker rows is radial to the drum while the polarity of the thinner rows is circumferential to the drum. Each alternate thick or thin magnet has an opposite polarity causing a closed magnetic flux flow path so that rotation of the rotor produces a rapidly alternating high density flux field inducing repulsive forces in the metal pieces which aids separation.

U.S. Pat. No. 4,834,870 discloses a method for sorting non-ferrous metal pieces. This method involves moving the metal pieces at a predetermined speed through a rapidly changing, high flux density magnetic field. The field develops a repulsive force in the pieces which differs in magnitude for different non-ferrous metals. The distance each piece travels is affected by its developed, magnetically-induced repulsive force, in addition to the forces of inertia and gravity. The lengths of the trajectories may be controlled by adjusting the speed of the conveyor (which adjusts the momentum of the pieces) and by adjusting the rotational speed of the drum (which adjusts for the frequency of the changes in the magnetic field and, consequently, the magnitude of the induced repulsive forces).

U.S. Pat. No. 4,743,364 discloses a separator apparatus for separating conductive material from nonconductive material, with neither type of material being magnetic. The apparatus includes two magnetic means, one comprising a permanent magnetic means for producing a steady gradient field, and the other including at least one coil for producing a varying magnetic field.

U.S. Pat. No. 4,238,323 describes electrodynamic separation of non-ferrous materials by feeding the flow of material into region of maximum intensity of a variable, non-uniform magnetic field to induce maximum eddy currents in the conductive particles of the material being separated and to produce maximum electromagnetic forces which deflect the conductive particles from the feed of the material being separated. The magnetic field is generated by an electromagnet having a closed magnetic core with a magnetic air gap defined by the pole pieces.

U.S. Pat. No. 4,069,145 describes a device utilizing a strong pulse-power electromagnetic field generated by an inductor which is used to accelerate various metal pieces. The separation of metals from nonmetals is based upon the conductivity of the materials. In this method, separation occurs as a result of the interaction between the electromagnetic field and the eddy currents generated in the metals, leading to a change in their trajectory. As a result, these trajectories differ from the initial trajectory of the nonconductive material as it falls from the feeder.

U.S. Pat. No. 4,029,573 discloses an apparatus for separating conductive nonferromagnetic metals comprising a plurality of inclined ramps, each with a steady-state magnetic means disposed to establish an alternating series of oppositely directed and substantially parallel magnetic fields, which separate the streams of materials based upon their conductivities.

U.S. Pat. No. 1,829,565 discloses a separation apparatus comprising a solenoid coil connected to a high frequency, alternating current source. A flow of freely falling particles is fed close to the coil end. The variable magnetic field of the coil induces eddy currents in the conductive particles moving close to the coil end. Interaction of the magnetic field of the coil and the eddy currents in the particles produces electromagnetic forces which results in deflecting the electrically conducting particles from their free fall, while the direction of the nonconducting particles remains unaffected. The flow of particles being separated is thus divided into at least two flows.

Other systems, sometimes called heavy media separators, separate non-ferrous metals such as aluminum, zinc, copper, brass, stainless steel and lead using a medium of specific gravity which is controlled to first float the materials to be separated at a specific gravity of 1.5 or less, and then at a specific gravity of 2.7–3.2 to float aluminas. The other materials can then be manually separated.

There remains a need for apparatus and methods to efficiently and reproducibly separate and sort non-ferrous metals.

SUMMARY OF THE INVENTION

The present invention describes an apparatus and method for separating and sorting non-ferrous metals according to their densities. A short electrical pulse from a powerful magnetic field is used for separation. The electromagnetic field is generated by an inductor that is charged by the discharge of a capacitor bank. The non-steady state, magnetic field is sufficient to produce a sharp skin effect in the nonferrous metal pieces. The non-ferrous metal pieces are then sorted according to their density and independent of their conductivity in a non-uniform, magnetic field created by the apparatus.

Various means of adjusting the magnetic field are provided to create a uniform distribution of forces acting upon the metal pieces for separation. For example, adjustments to the magnetic field can be created by a non-uniform current distribution by the inductor, changing the shape of the inductor core, altering the arrangement of the inductors, introducing mechanical or electromagnetic deflectors into the magnetic field, or any combination thereof.

BRIEF DESCRIPTION OF THE DRAWINGS

FIG. 6 shows several different embodiments of an apparatus of the present invention.

FIG. 8 shows embodiments wherein non-flat inductors are used to correct the magnetic field to provide sufficient momentum to propel metals according to their density.

FIG. 10 depicts embodiments wherein the conveyor is placed into a gap between two poles of the ferromagnetic core.

FIG. 11 shows assemblies having a mushroom-like shaped ferromagnetic core.

DETAILED DESCRIPTION OF THE INVENTION

Figure 1:
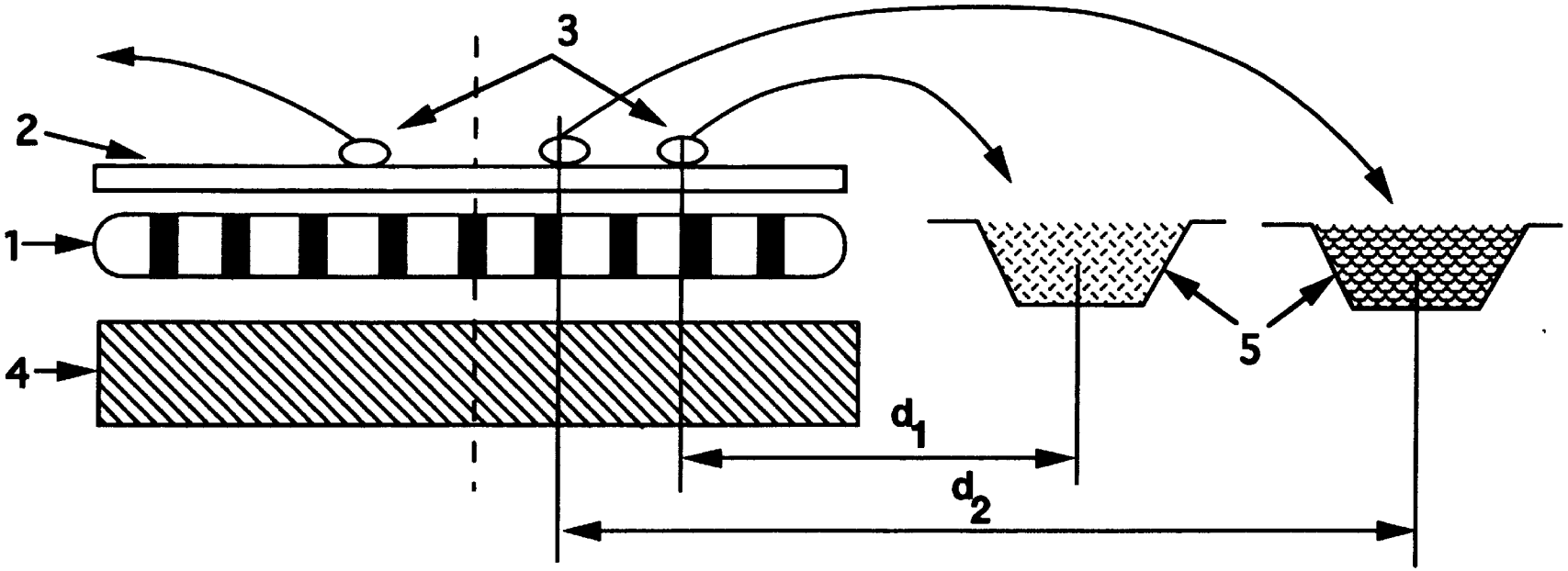
FIG. 1 provides a schematic of one embodiment of an electrical material separator apparatus of the present invention wherein the means to separate and sort non-ferrous metal pieces according to their density and independent of the conductivity of each non-ferrous metal piece comprises an inductor or series of inductors generating a non-steady state, non-uniform magnetic field in the area of an infeed conveyor where metal pieces to be separated are located. A ferromagnetic core significantly reduces the required amount of energy from a capacitor or series of capacitors which power the inductor or inductors. Pieces to be separated having different densities and like geometrical factors receive the same initial momentum but are displaced at various distances $d_1$ and $d_2$ and end up in the collecting bins or containers for each selected material.
Figure 2:
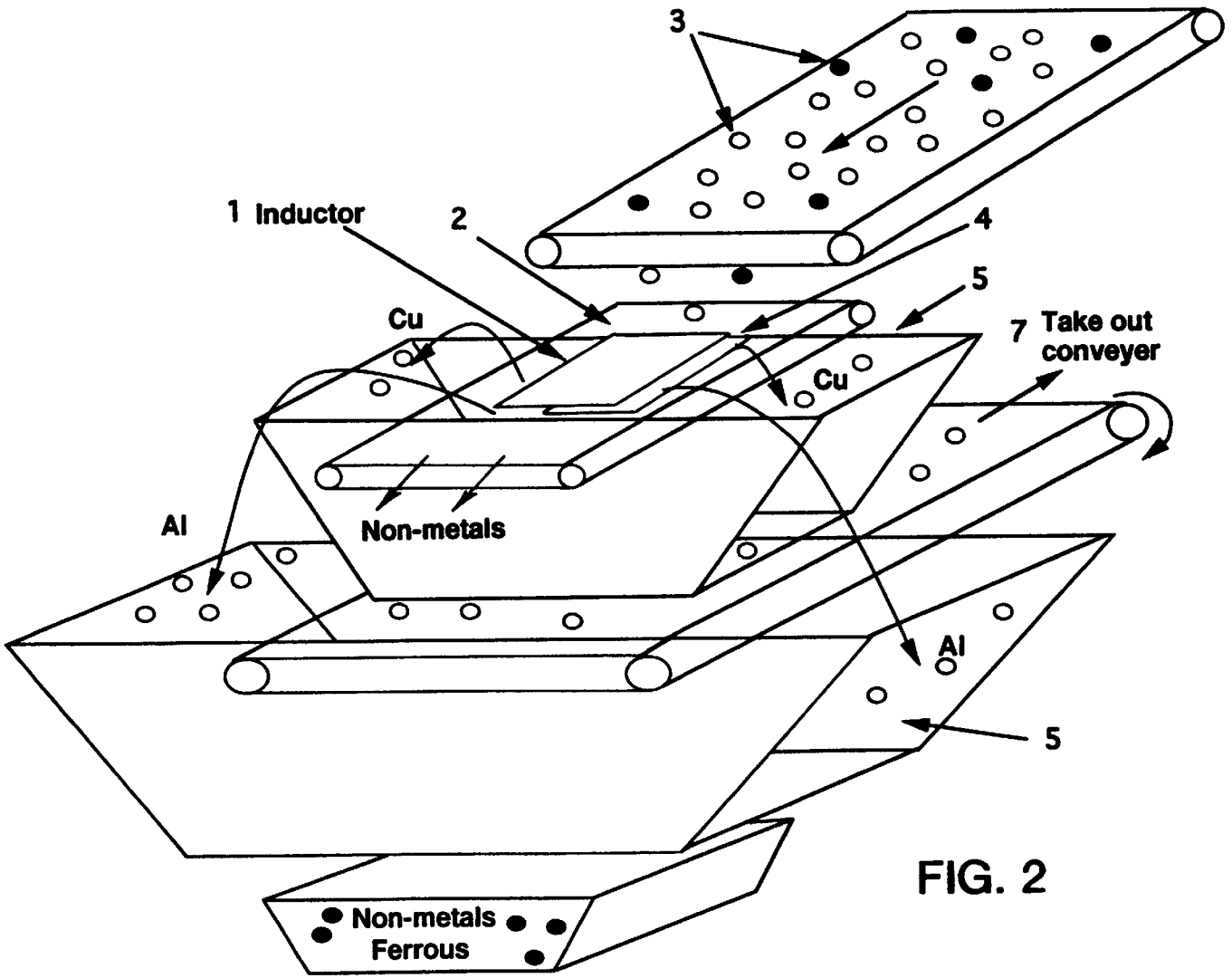
FIG. 2 shows an embodiment of a separation apparatus of the present invention for separating and sorting copper and aluminum pieces from each other and other materials.

It is highly desirable to separate non-ferrous metals from other materials and from each other. Such methods of separation are useful in a number of different industries including, but not limited to, the recycling industry for the separation of metals for recycling, the mining industry for ore separation, the food industry for the separation of grains from metal parts, and the chemical industry for the decontamination of powders contaminated with metal pieces. The present invention provides an apparatus and method for separating non-ferrous metals and alloys such as aluminum, copper, brass, bronze, magnesium, lead, tin and zinc from other materials.

In the present invention, a mixture of non-ferrous, ferrous and nonmetal materials is separated and sorted according to the specific densities of the non-ferrous materials and independent of their conductivity. Eddy currents are generated in the conductive pieces of the mixture which leads to an interaction between these eddy currents and a primary magnetic field. As a result, pieces of non-ferrous metals are propelled along various ballistic trajectories that are both predictable and reproducible. Through their interaction, non-ferrous materials covering a wide spectrum of density are separated as a result of achieving a sharp skin effect in the conductive material. A conductor experiences a sharp skin effect when the depth of penetration of the electromagnetic field into the conductor is ten or more times less (orders of magnitude) than the thickness of the conductor. Knoepfel, H. "Pulsed High Magnetic Fields: Physical effects and generation methods concerning pulsed fields up to the megaoersted level", Laboratorio Gas Ionizzati (Euroatom-CNEN) Frascati, North-Holland Publishing Co., Amsterdam, London, 1970, p. 394; Shneerson G. A. "Fields and unsteady-state processes in the apparatuses of super-high currents", 2nd Ed. Energoatomisdat, 1992, p. 416. This is achieved by creating a magnetic field where the frequency (AC) of the magnetic field is no less than a value calculated based upon the specific resistivity of a metal with the lowest conductivity among the metals to be sorted and the smallest size of the sorted metal pieces. As a result, metal pieces are propelled at distances which are inversely proportional to the densities of these materials and independent of their conductivities.

TABLE 1

| Non-ferrous Metal | Specific Resistivity (Ωm) | Density (kg/m$^3$) | Distance (m) |
|---|---|---|---|
| Gold | $2.2 \times 10^{-8}$ | $19.3 \times 10^3$ | 0.02 |
| Copper | $1.78 \times 10^{-8}$ | $8.95 \times 10^3$ | 0.09 |
| Brass | $7.51 \times 10^{-8}$ | $8.5 \times 10^3$ | 0.095 |
| Zinc | $5.92 \times 10^{-8}$ | $6.9 \times 10^3$ | 0.15 |
| Aluminum | $2.65 \times 10^{-8}$ | $2.7 \times 10^3$ | 0.9 |

Data in the table were calculated at frequency f=2KHz, induction B=1T, size of the metal pieces 15–40 mm, time= $10^{-3}$c.

The apparatus of the present invention comprises in simplest form a means for producing an electromagnetic field, an infeed conveyor, a ferromagnetic core, and a collecting means. A number of preferred embodiments of the present invention are depicted in FIGS. 1, 2, 3, 6, 7, 8, 9, 10 and 11. For example, it is preferred that the means for producing an electromagnetic field comprise an inductor or series of inductors 1 and a capacitor 8 or series of capacitors. Preferably, the inductor further comprises cooling means. The inductor 1 generates a non-uniform magnetic field in the area of the infeed conveyor 2 where the metal pieces 3 to be separated are located. A ferromagnetic core 4 maintains and intensifies the amount of energy produced by the capacitor which powers the inductor or series of inductors 1. In a preferred embodiment, the capacitor 8 is connected by means of a switch 11 to the inductor 1. See FIG. 5. To provide a continuous sorting process, the capacitor 8 charges the inductor or inductors 1 with such frequency that during the time interval between pulses, metal pieces 3 move at a distance equal to the length of the infeed conveyor 2 where the inductor or inductors 1 are located and are exposed to the magnetic field. Materials to be sorted with different densities and identical geometry receive the same initial momentum but are displaced at various selected distances $d_1$ and $d_2$ and end up in the collecting means 5 so that the materials are sorted into selected groups. See FIG. 4. A scatter in the trajectories of identical metals depends not only on the variations in their geometry but also on their orientation and initial position on the infeed conveyor 2. This scatter can be reduced by adjusting the magnetic field and trajectories of the pieces. This is accomplished in a number of ways.

Figure 3:
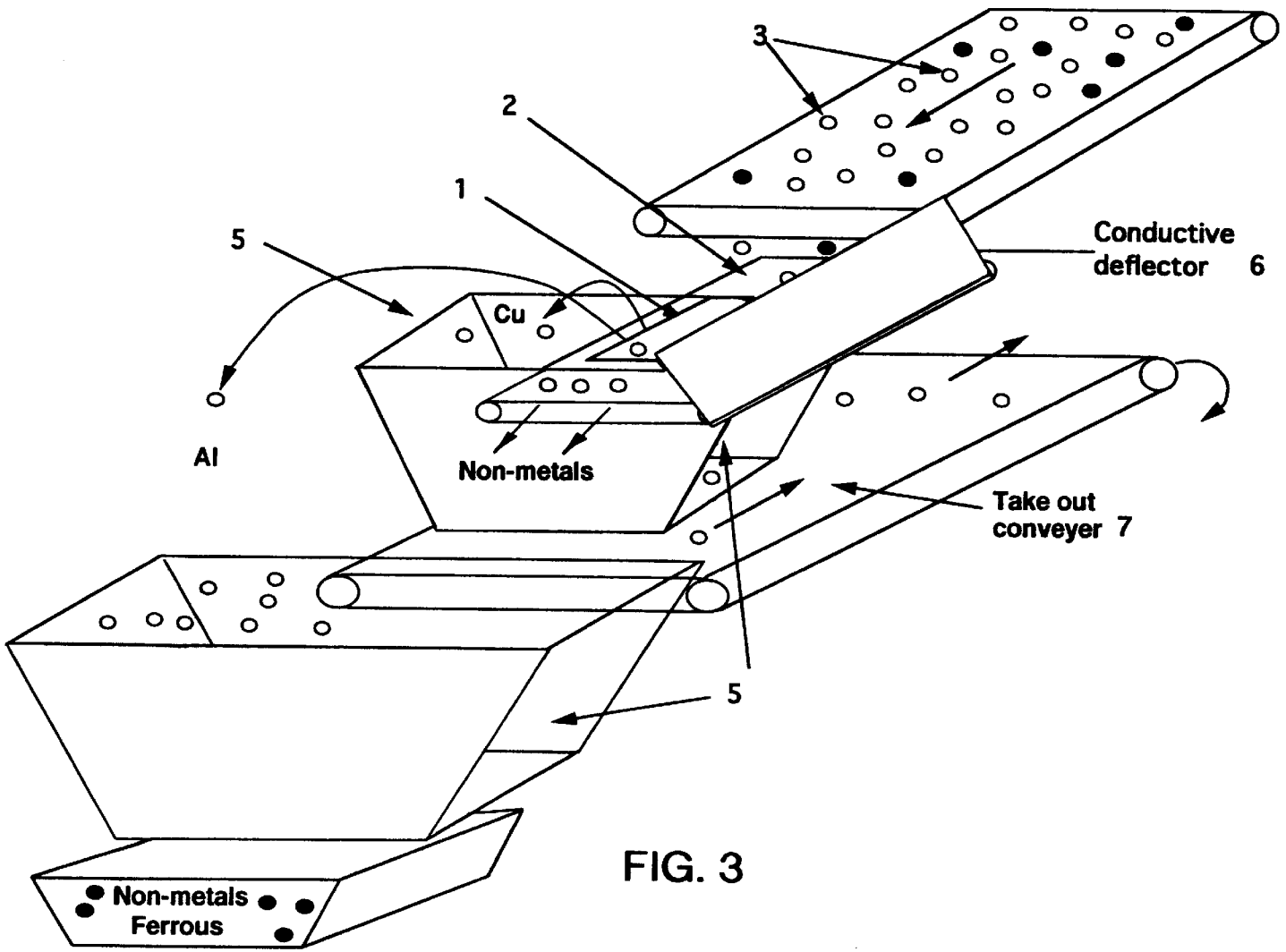
FIG. 3 shows an alternative embodiment of a separation apparatus of the present invention further comprising a deflector.
Figure 6A:
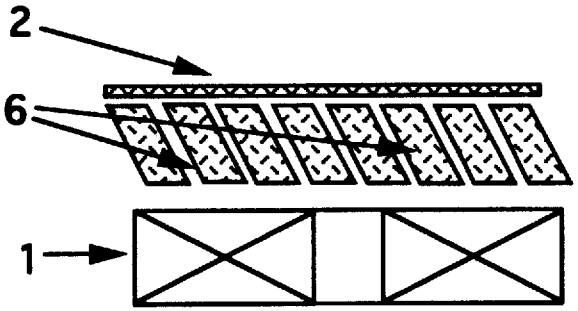
FIG. 6A shows one embodiment wherein multiple electromagnetic deflectors are placed close to the surface of the conveyor. During discharge of the capacitor onto the inductor, eddy currents are generated in the deflectors thereby correcting the direction of the forces acting on the metals to be separated.
Figure 6B:
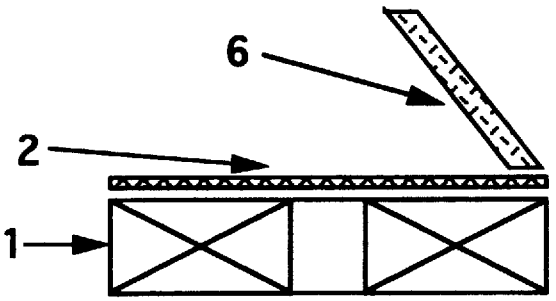
FIG. 6B shows an embodiment having one electromagnetic and mechanical deflector.
Figure 6C:
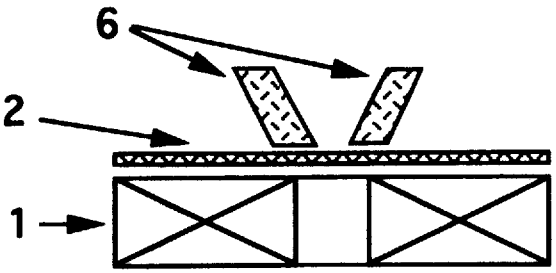
FIG. 6C shows an embodiment wherein two deflectors are used to deflect metal pieces to the sorting containers place on both sides of the conveyor.
Figure 6D:
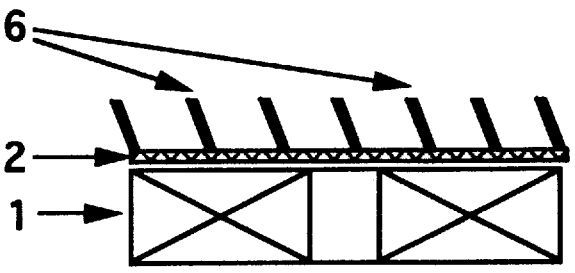
In FIG. 6D, multiple electromagnetic and mechanical deflectors are used to deflect the metal pieces.

For example, the apparatus may further comprise a conductive deflector or deflectors 6 which interact with the generated magnetic field and mechanically deflect and sort non-ferrous metal into containers 5. As depicted in FIGS. 3 and 6, a deflector or deflectors 6 are used to assist in propelling the metal pieces 3. During discharge of the capacitor 8 onto the inductor 1, eddy currents are generated in the deflector or deflectors 6 thereby correcting the direction of the forces acting on the metal pieces. A single deflector may be used as depicted in FIG. 6B. Alternatively, multiple deflectors can be used. See FIG. 6A, 6C and 6D.

Figure 7:
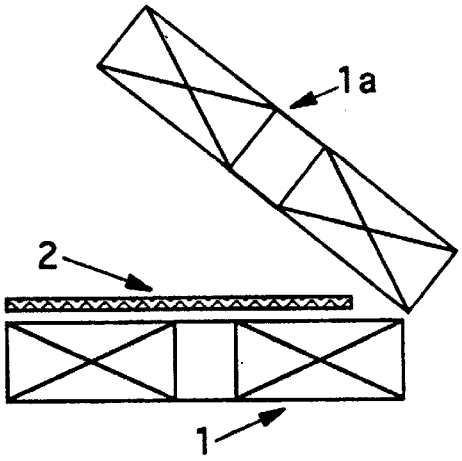
FIG. 7 shows an assembly of two inductors 1 and 1*a*. In this embodiment, the second inductor, labeled 1*a,* performs the correction of the electromagnetic field which provides a sufficient momentum to propel metal according to its density.

In addition, a series of inductors may be used. FIG. 7 provides embodiments wherein two inductors 1 are used for adjusting the electromagnetic field generated at the infeed conveyor 2. It is preferred that the series of inductors be arranged in parallel, each inductor having an independent discharge system. It is also preferred that the inductors have a non-uniform amp-turns distribution wherein the turns are of a non-uniform thickness.

Figure 8A:
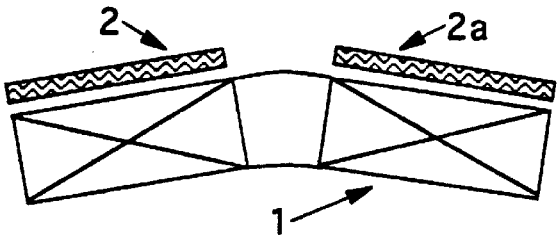
In FIG. 8A, there are two infeed conveyors which are located on top of both sides (direct and reversed current) of the inductor.
Figure 8B:
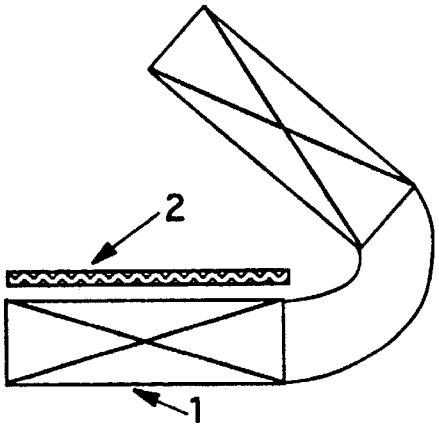
In FIG. 8B, only one infeed conveyor is used.

The shape of the inductor can also be varied. For example, FIG. 8 shows embodiments wherein a non-flat inductor 1 is used to adjust the magnetic field. In FIG. 8A, two infeed conveyors 2 are located on top of both sides (the direct and reversed current) of the inductor 1. In FIG. 8B, the apparatus has the inductor 1 located around the infeed conveyor 2.

Figure 9:
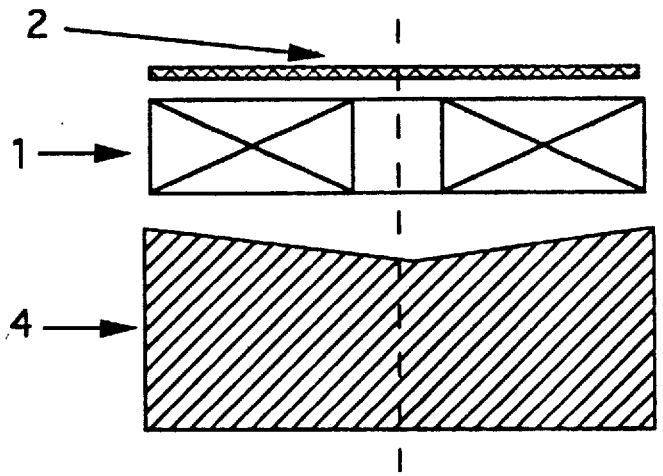
FIG. 9 shows an embodiment wherein there is a nonuniform gap between the inductor and the ferromagnetic core.
Figure 10B:
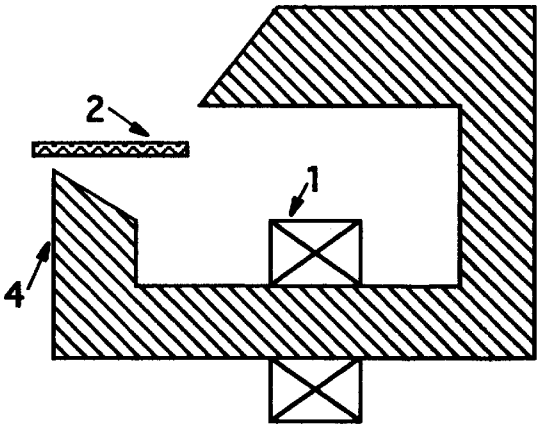
In FIG. 10B, the inductor is placed closer to the infeed conveyor.
Figure 10A:
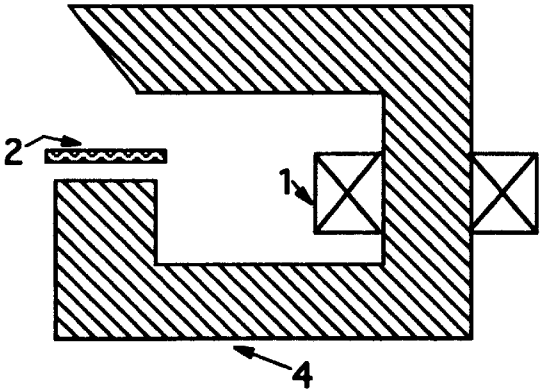
In FIG. 10A, the inductor is place on the opposite side of the ferromagnetic core to the infeed conveyor.

Alternatively, the gap between the inductor and the ferromagnetic core can be altered along with the position of the infeed conveyor with relation to the inductor and the ferromagnetic core. FIG. 9 depicts an embodiment wherein there is a non-uniform gap between the inductor 1 and the ferromagnetic core 4. FIG. 10 shows embodiments wherein the infeed conveyor 2 is located in a gap between the two poles of the ferromagnetic core 4 at a selected distance from the inductor 1.

Figure 11B:
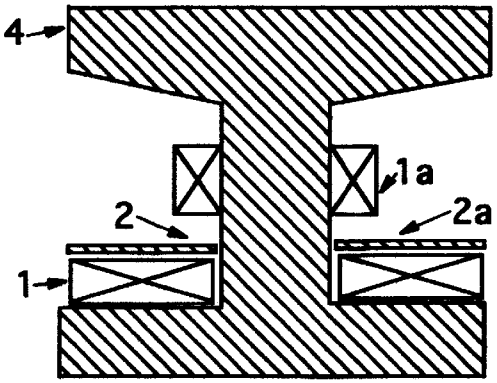
FIG. 11B shows an embodiment having two infeed conveyors and two inductors.
Figure 11A:
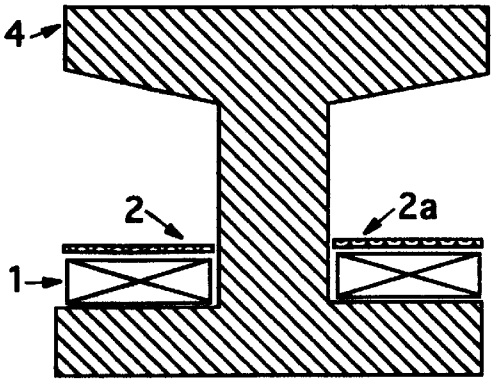
FIG. 11A shows an embodiment having two infeed conveyors and a single inductor.

The shape of the ferromagnetic core 4 can also be altered. In FIG. 11 embodiments of the invention are shown wherein the ferromagnetic core 4 is fabricated in a mushroom-like shape and the inductor 1 and infeed conveyors 2 are located so that the magnetic field is capable of propelling the metal pieces different distances based upon their density.

Figure 12:
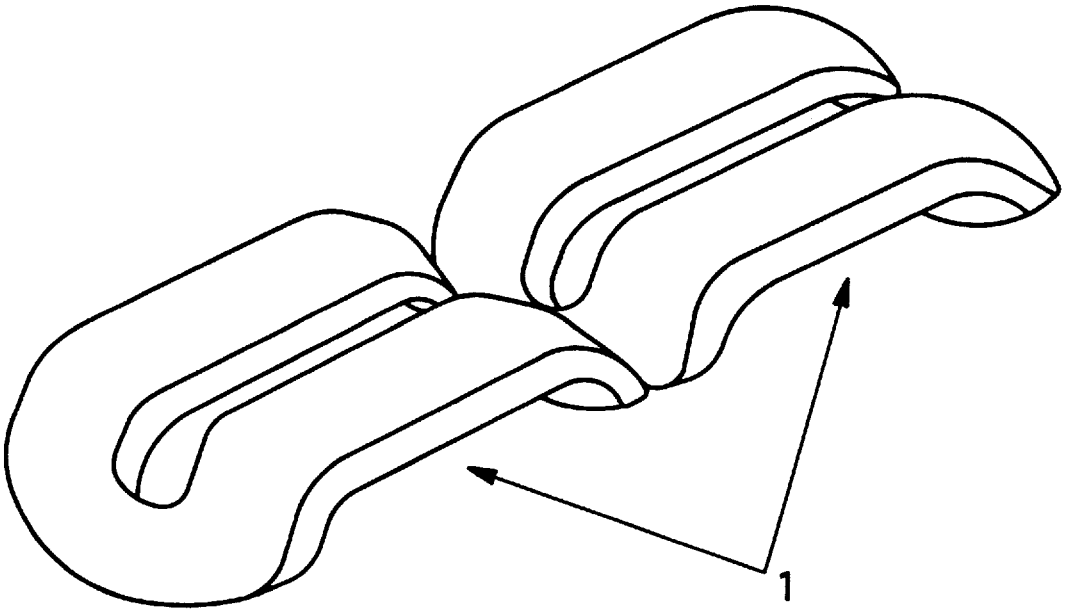
FIG. 12 shows an assembly of several inductors with bent edges which can be placed along the infeed conveyor to eliminate areas of reduced electromagnetic field.
Figure 13:
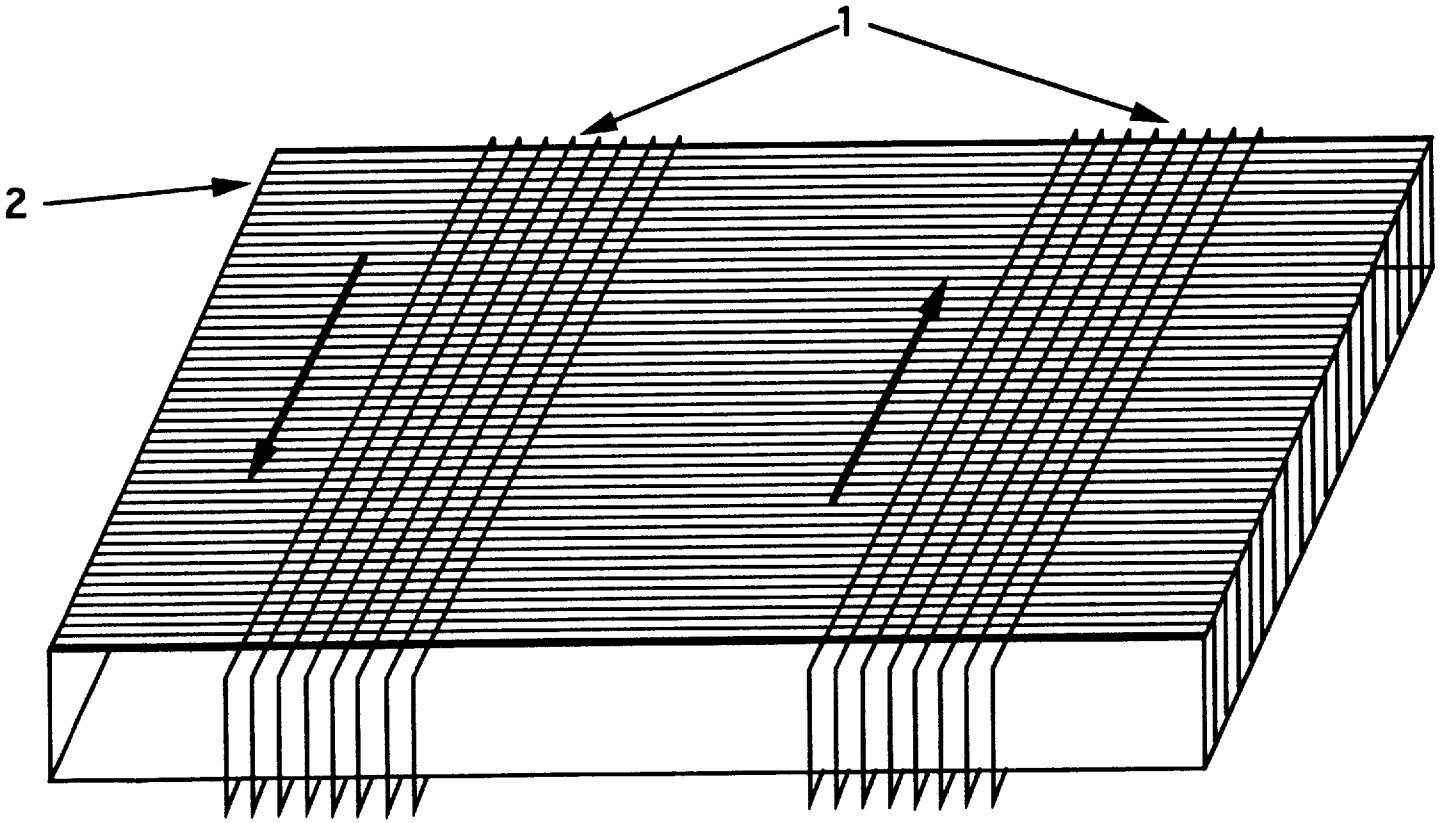
FIG. 13 shows an embodiment of the present invention wherein the inductor or inductors are placed around the ferromagnetic core.

Assemblies of inductors 1, as shown in FIG. 12, can be placed along the infeed conveyor 2 to eliminate areas where the magnetic field is reduced. FIG. 13 shows an apparatus having an assembly of inductors 1 placed along the infeed conveyor 2 without areas of reduced electromagnetic field.

Figure 5:
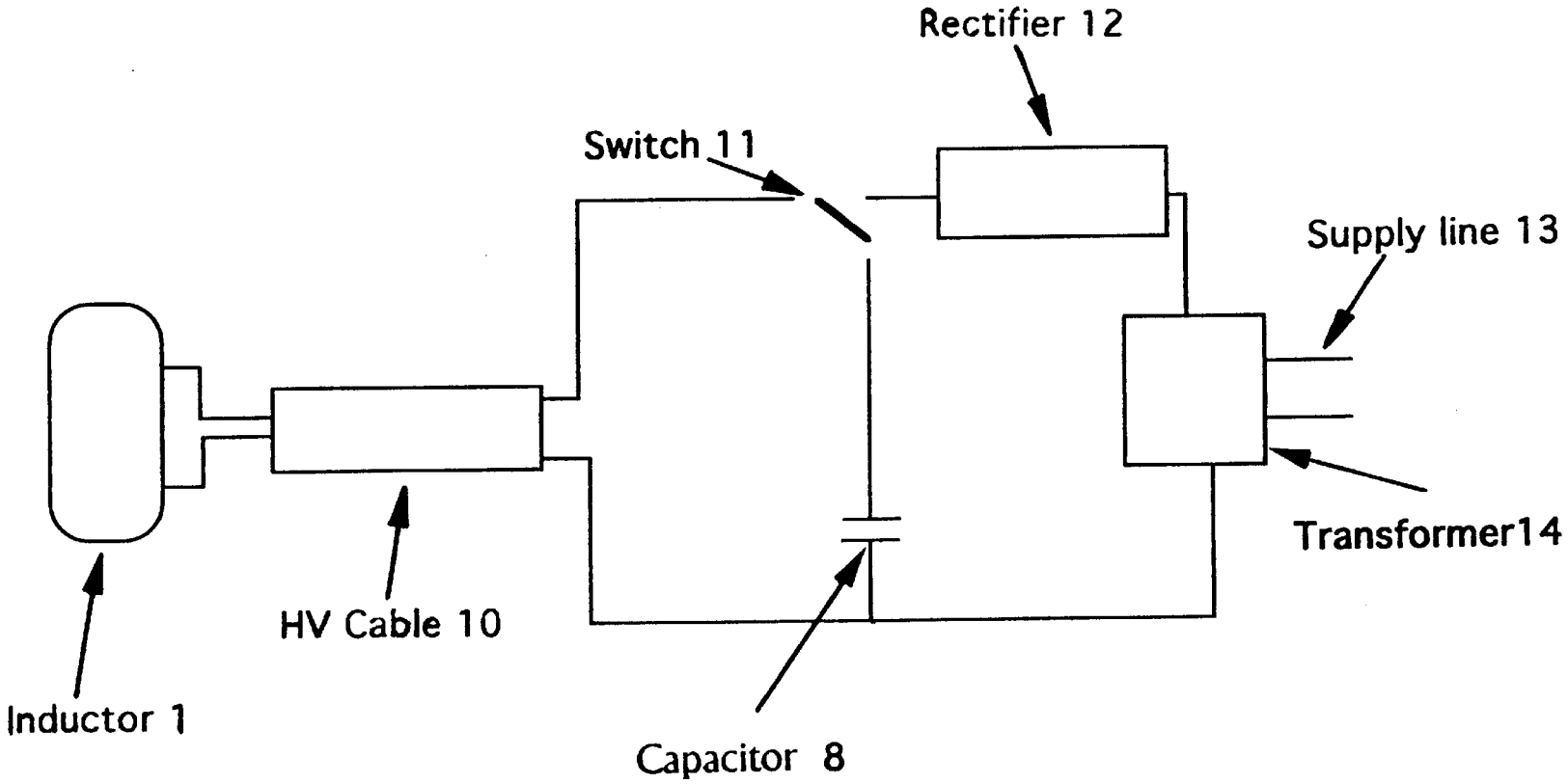
FIG. 5 is a schematic of an electrical circuit that can be used to provide continuous operation of the separation apparatus.

A schematic of one embodiment of an electrical circuit that can be used to provide continuous operation of the separation apparatus of the present invention is provided in FIG. 5. As depicted in this Figure, the inductor 1, receives power from a supply line 13 via an HV cable 10 attached to a electrical circuit comprising a capacitor 8, a transformer 14 and a rectifier 12. Power is controlled by a switch 11 connected to the capacitor 8. In a preferred embodiment, a plurality of capacitors 8 can be arranged in series to increase the frequency of the power discharge.

The invention is further illustrated by the following, nonlimiting examples.

EXAMPLES

Example 1

Figure 4:
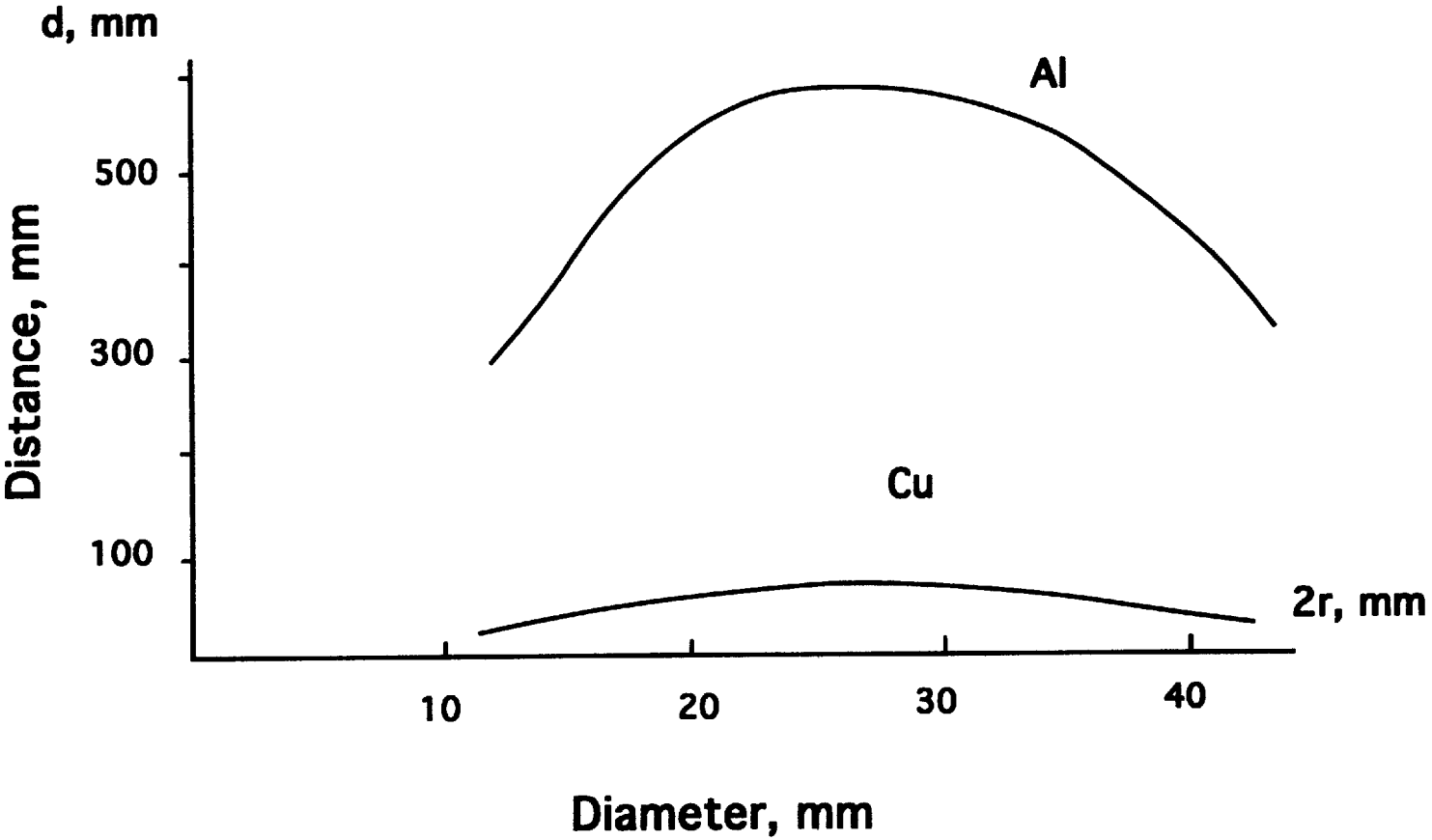
FIG. 4 is a graph showing the separation of spherical pieces of aluminum and copper. The distance at which the non-ferrous metal pieces jumped (in mm) is plotted in relation to their diameter (in mm).

The separation of spherical pieces of various metals was accomplished. In these experiments, magnetic induction was 0.8 T, cyclic frequency was 1200 1/s, and the damping coefficient was 1000 1/s. The capacitor bank with the stored energy 2 KJ was discharged to a flat inductor with 13 winds. The results of these experiments are shown in FIG. 4, where the distance at which the metal pieces jumped is plotted in relation to their diameter. The distance for aluminum is approximately ten times greater than for copper.

What is claimed:

1. An apparatus for separating and sorting non-ferrous metal pieces from other materials according to density comprising:

(a) a capacitor and inductor for producing an electromagnetic field which provides a non-steady state, non-uniform magnetic field, and produces a sharp skin effect in the non-ferrous metal pieces so that the non-ferrous metal pieces are propelled at distances which are inversely proportional to the densities of these materials and independent of their conductivities;

(b) a ferromagnetic core;

(c) an infeed conveyor for positioning materials to be separated and sorted between said capacitor and inductor for producing an electromagnetic field and said ferromagnetic core; and (d) a collecting means located at a selected distance from said infeed conveyor for collecting separated and sorted non-ferrous metal pieces propelled by the electromagnetic field.

2. The apparatus of claim 1 wherein a plurality of inductors are assembled in parallel.

3. The apparatus of claim 2 wherein each inductor has an independent discharge system.

4. The apparatus of claim 1 wherein the inductor has a non-uniform amp-turns distribution.

5. The apparatus of claim 4 wherein the turns are of a non-uniform thickness.

6. The apparatus of claim 1 further comprising a deflector attached to said infeed conveyor.

7. A method for separating and sorting non-ferrous metal pieces from other materials according to density comprising:

propelling non-ferrous metal pieces at distances inversely proportional to the densities of the metal pieces and independent of their conductivities by placing the metal pieces in a non-steady state, non-uniform magnetic field generated by an inductor so that and a sharp skin effect is produced in the non-ferrous metal piece; and collecting the propelled non-ferrous metal pieces in collecting means located at selected distances from the inductor.

* * * * *